US008857237B2

(12) United States Patent
Chien

(10) Patent No.: US 8,857,237 B2
(45) Date of Patent: Oct. 14, 2014

(54) METHOD FOR FORMING HIGH-STRENGTH STEEL INTO A C-SHAPE

(76) Inventor: Yong-Wah Chien, Taoyuan County (TW)

( * ) Notice: Subject to any disclaimer, the term of this patent is extended or adjusted under 35 U.S.C. 154(b) by 309 days.

(21) Appl. No.: 13/304,710

(22) Filed: Nov. 28, 2011

(65) Prior Publication Data

US 2012/0067098 A1 Mar. 22, 2012

Related U.S. Application Data

(63) Continuation-in-part of application No. 12/324,837, filed on Nov. 27, 2008, now abandoned.

(51) Int. Cl.

| | |
|---|---|
| ***B21D 22/00*** | (2006.01) |
| ***B21D 22/02*** | (2006.01) |
| ***B21D 22/06*** | (2006.01) |
| ***B21D 22/22*** | (2006.01) |
| ***B21D 24/04*** | (2006.01) |

(52) U.S. Cl.

CPC ..... *B21D 22/02* (2013.01); *B21D 22/06* (2013.01); *B21D 22/22* (2013.01); *B21D 24/04* (2013.01)

USPC ..... 72/347; 72/350

(58) Field of Classification Search

CPC ..... B21D 22/00; B21D 22/02; B21D 22/06; B21D 22/10; B21D 22/20; B21D 22/22; B21D 24/04; B21C 3/06; B21C 3/12

USPC ..... 72/334, 347, 348, 349, 350, 465.1, 468

See application file for complete search history.

(56) References Cited

U.S. PATENT DOCUMENTS 7,900,492 B2 * 3/2011 Komatsu ..... 72/348
8,051,696 B2 * 11/2011 Yoshida et al. ..... 72/347

FOREIGN PATENT DOCUMENTS

DE 3623188 C1 * 9/1987

* cited by examiner

*Primary Examiner* — Teresa M Ekiert

(57) ABSTRACT

The method is performed by a power press machine composed of a concave die, a convex die with two shoulders and two depressors separately beside the convex die, and includes the steps of: a) placing the high-strength steel (HSS) on the convex die and under the concave die; b) moving the depressors to have two opposite side portions of the HSS clamped between the concave die and the depressors; c) moving the convex die to press the HSS and keeping the side portions immovable; d) forming two steps adjacent to the side portions by the shoulders; and e) cutting off the steps with the side portions.

1 Claim, 10 Drawing Sheets

METHOD FOR FORMING HIGH-STRENGTH STEEL INTO A C-SHAPE

CROSS-REFERENCE TO RELATED APPLICATIONS

This application is a continuation-in-part of U.S. patent application Ser. No. 12/324,837, filed Nov. 27, 2008, now abandoned.

BACKGROUND OF THE INVENTION

1. Technical Field

The invention relates to steel sheet forming processes, more particularly to a technique of bending high-strength steels.

2. Related Art

Because metals have good strength and flexibility, they are usually used as a structural element requiring strength. When a force applied on a unit area of metal exceeds its tensile strength, the metal will not split like ceramic materials, but will be deformed. That is to say, metals have a property of plasticity, i.e. plastic deformation. Usually, a power press machine is used for deforming a metal. There is a concave die and a convex die in a power press machine. By means of stroke, the metal material being placed between the two dies can be deformed as the shape formed by the dies.

FIG. 1 illustrates a conventional technique of forming a high-strength steel (HSS) sheet into a C-shape. The HSS 10 is placed between a concave die 20 and a convex die 22. During the pressing process, two depressors 24 are disposed beside the convex die 22 and used for clamping two opposite sides 12 of the sheet 10. As shown in FIG. 2, however, after the pressing action, the sides 12 of the sheet 10 tend to become an undesired warp or curl (i.e. "recoil") because of its inner stress against the pressing force. Thus, the quality of HSS sheet forming will be adversely affected. As shown in FIG. 2, the shape 12 depicted by broken lines is the desired shape of sheet, but a really resultant shape is like the shape 12'.

Moreover, an additional post-production is required because the desired shape can not be accomplished at a time. Therefore, the conventional forming process with post-production includes the steps of : a)forming; b)cutting; c)trimming and d)re-trimming or, a)loading; b)forming; c)re-forming; d)trimming and e)re-trimming. Any of the above processes is lengthy and tardy. The most important point is that pressing veins or scratches will be left on the sheet after these steps. Quality of the finished products will be considerably low unless a finally additional polishing step is performed.

For example, in order to avoid warps or curls, and to increase accuracy of the products formed, the steps of forming and trimming must be repeatedly performed. It is very uneconomic. Furthermore, the forming process with multiple forming and trimming steps may also reduce lifetime of the dies. Meanwhile, the formed products will be hardened. It is disadvantageous to the latter process.

SUMMARY OF THE INVENTION

A primary object of the present invention is to provide a method for forming high-strength steel into a C-shape, which can avoid recoil after the HSS is formed.

Another object of the present invention is to provide a method for forming high-strength steel into a C-shape, which can shorten the forming process because of the avoidance of recoil.

Still another object of the present invention is to provide a method for forming high-strength steel into a C-shape, which can improve quality of finished products being formed by means of one-time forming.

To accomplish the above-mentioned objects, the method of the present invention is performed by a power press machine composed of a concave die, a convex die with two shoulders and two depressors separately beside the convex die, and includes the steps of: a) placing the high-strength steel (HSS) on the protrusion of the convex die and under the concave die; b) making two opposite side portions of the HSS clamped between the concave die and the depressors; c) making the HSS pressed by the protrusion and keeping the side portions immovable; d) forming two steps adjacent to the side portions by the shoulders; and e) cutting off the steps with the side portions.

BRIEF DESCRIPTION OF THE DRAWINGS

The foregoing objects, features, and advantages of the present invention will be discussed in detail in the following non-limiting description of specific embodiments in connection with the accompanying drawings.

DETAILED DESCRIPTION OF THE INVENTION

Figure 1:
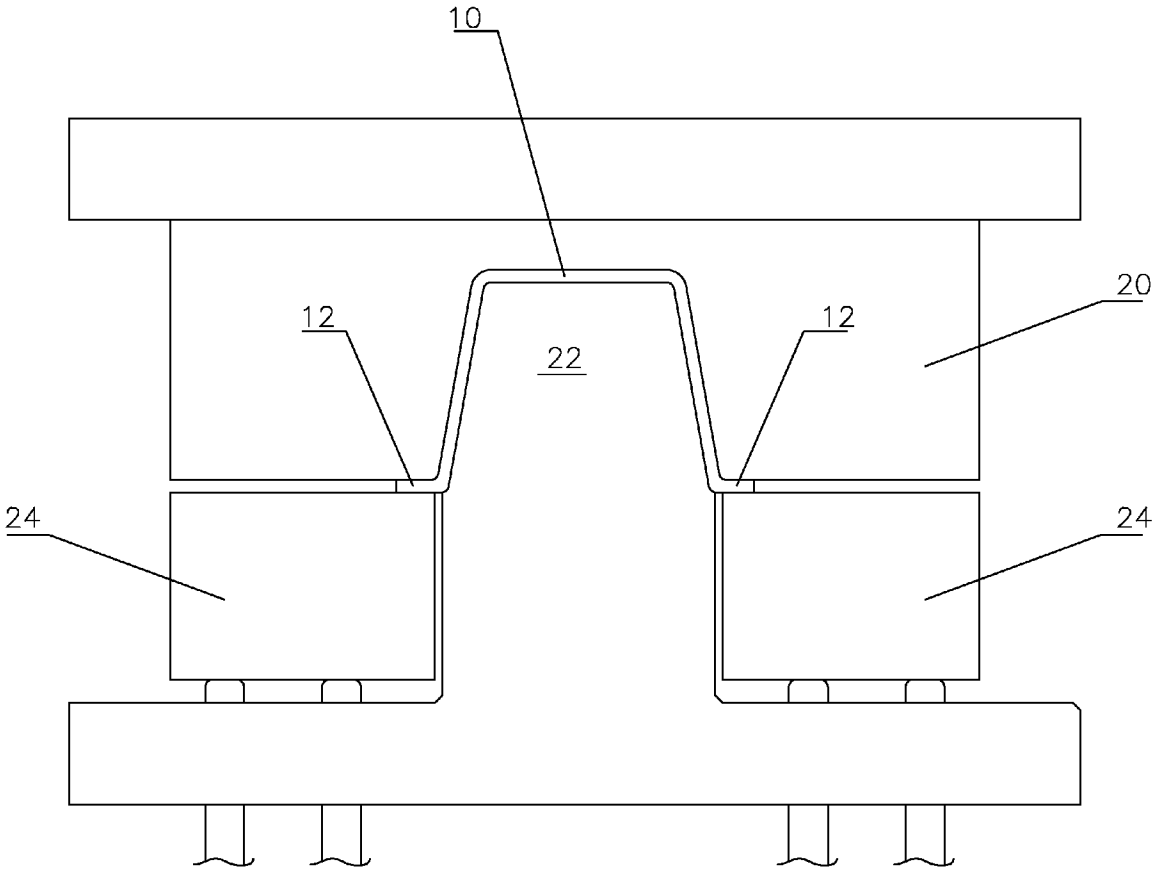
FIG. 1 Prior Art
FIG. 1 illustrates a conventional forming machine for high-strength steel (HSS)
Figure 2:
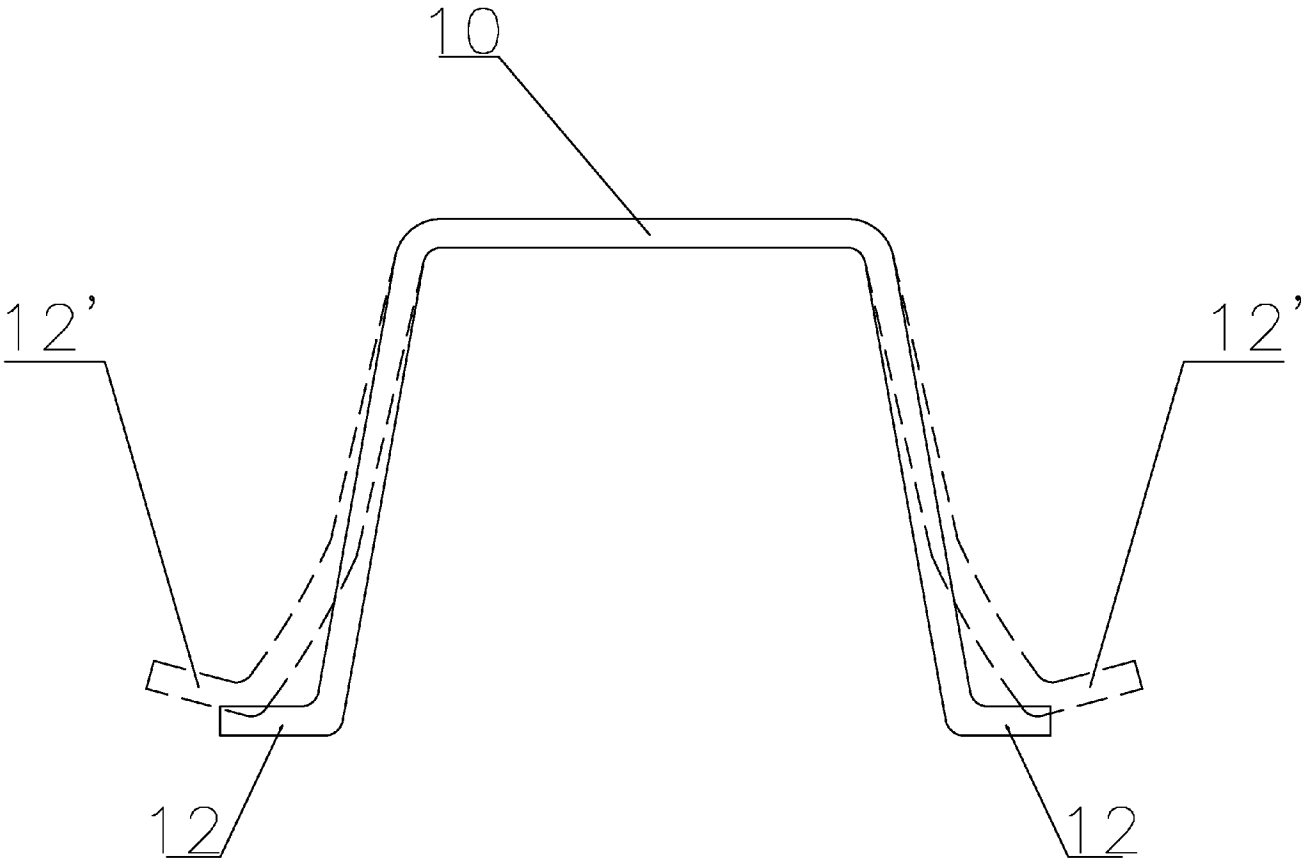
FIG. 2 Prior Art
FIG. 2 illustrates the HSS formed by the machine shown in FIG. 1.
Figure 3:
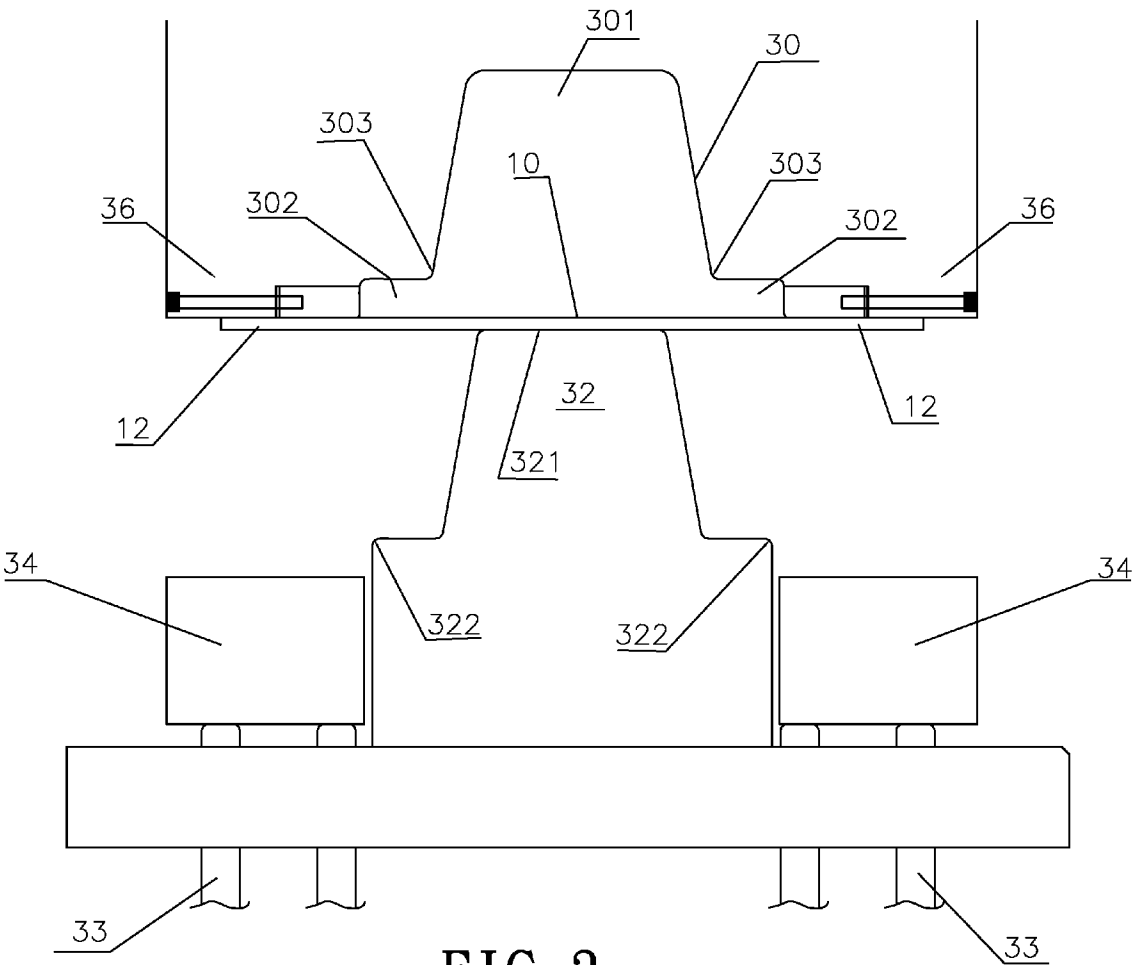
FIG. 3 illustrates the first status of the HSS formed by the power press machine of the present invention.

Referring to FIG. 3, the method of the invention is implemented by a power press machine includes a convex die 32, a concave die 30 and two depressors 34. The concave die 30 and the depressors 34 are moved by a first driving unit 31 and a second driving unit 33 to reciprocate upward and downward, respectively. The concave die 30 is formed with a concavity 301 and two recesses 302. And an angle 303 is formed by the concavity 301 and each the recess 302. The convex die 32 is composed of a protrusion 321 and two shoulders 322 respectively corresponding to the concavity 301 and the recesses 302 of the concave die 30 in shape and position. The depressors 34 are placed separately beside the convex die 32.

Initially, a high-strength steel (hereinafter "HSS") 10 is placed on the protrusion 321 of the convex die 32 and under the concave die 30 as shown in FIG. 3. In more detail, the middle portion of the HSS 10 is supported by the protrusion 321 and two opposite side portions 12 of the HSS 10 abut against the concave die 30. The depressors 34 are not in contact with the HSS 10.

Figure 4:
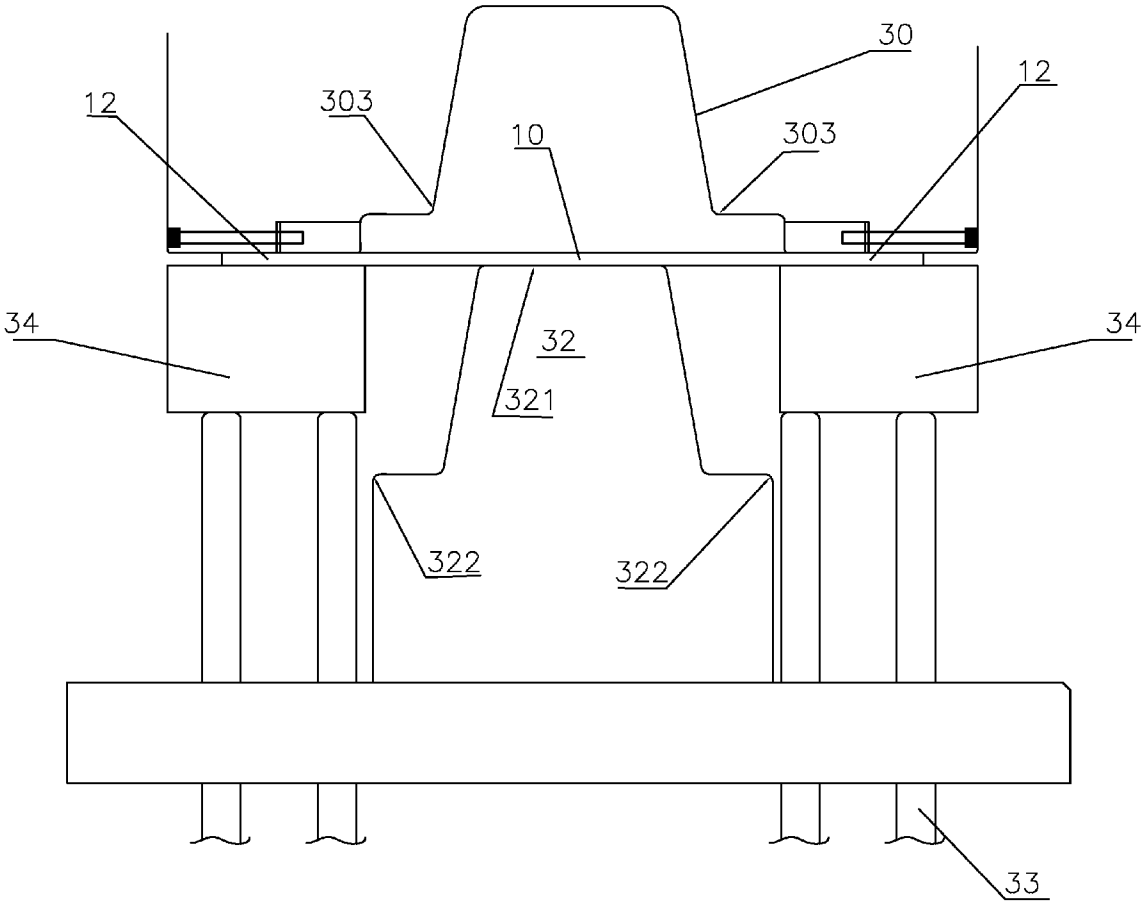
FIG. 4 illustrates the second status of the HSS formed by the power press machine of the present invention.

Please refer to FIG. 4. The depressors 34 are elevated to clamp the side portions 12 of the HSS 10 against the concave die 30. The clamping force to the HSS 10 is strong enough to make the side portions 12 immovable in all the pressing process. At this time, the concave die 30 and convex die 32 keep staying.

Figure 5:
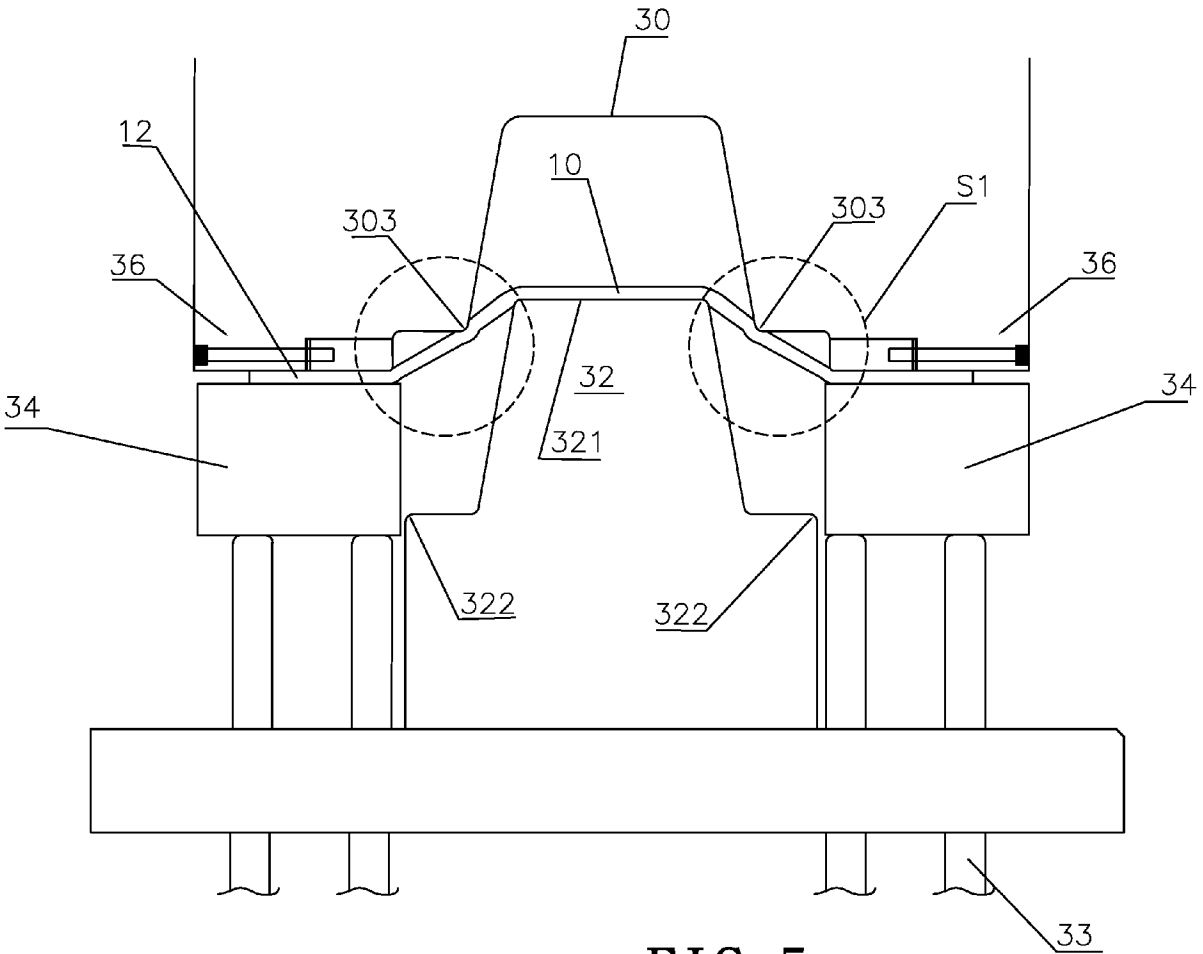
FIG. 5 illustrates the third status of the HSS formed by the power press machine of the present invention.

Please refer to FIG. 5. The next step is to lower the concave die 30 to make a middle portion of the HSS 10 pressed by the protrusion 321 of the convex die 32. At this time, the HSS 10 is being deformed by the protrusion 321 and is stretched in length and thinned in thickness because of the immovability of the side portions 12. Meanwhile, the depressors 34 are pressed by the concave die 30 to lower. Please note the circle S1 in the figure, two portions of the HSS 10 between the depressors 34 and the protrusion 321 are pressed by angles 303 of the concave die 30 when they are stretched. This can eliminate internal stress of the HSS 10.

Figure 6:
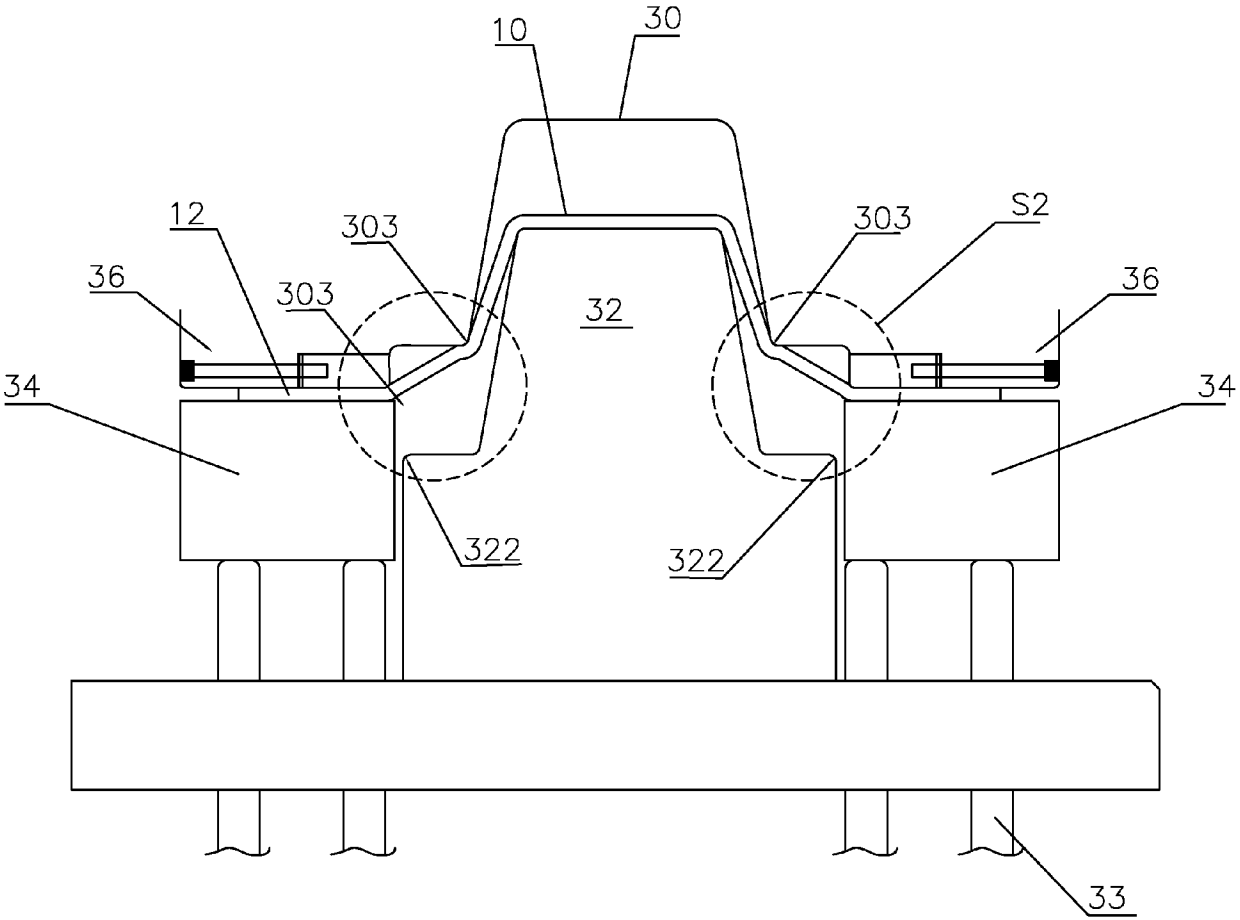
FIG. 6 illustrates the fourth status of the HSS formed by the power press machine of the present invention.
Figure 7:
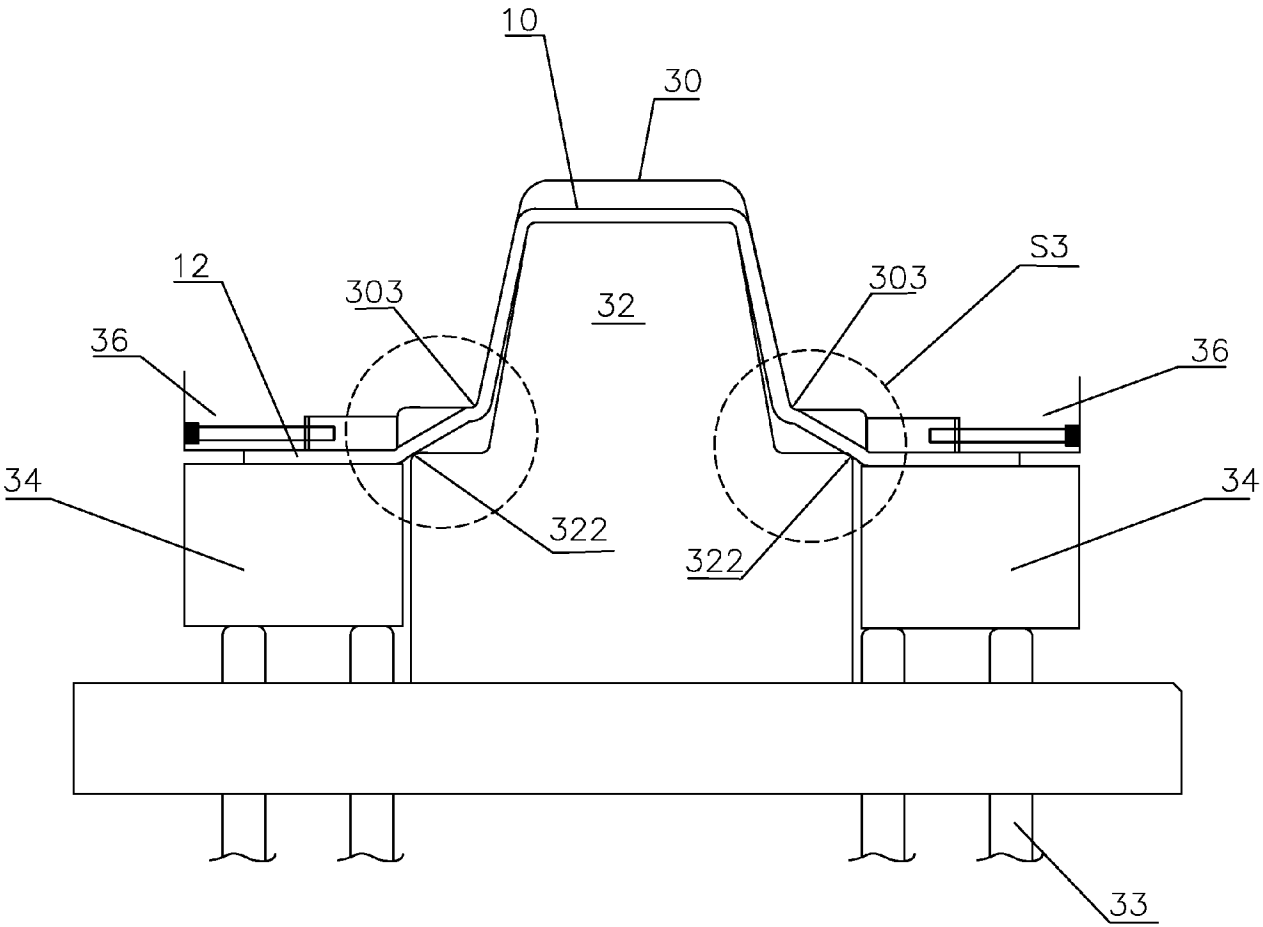
FIG. 7 illustrates the fifth status of the HSS formed by the power press machine of the present invention.

Please refer to FIG. 6. The concave die 30 further presses the HSS 10. Please note the circle S2 in the figure, the HSS 10 is still pressed by the angles 303 of the concave die 30. FIG. 7 illustrates a further status after FIG. 6 and please note the circle S3.

Figure 8:
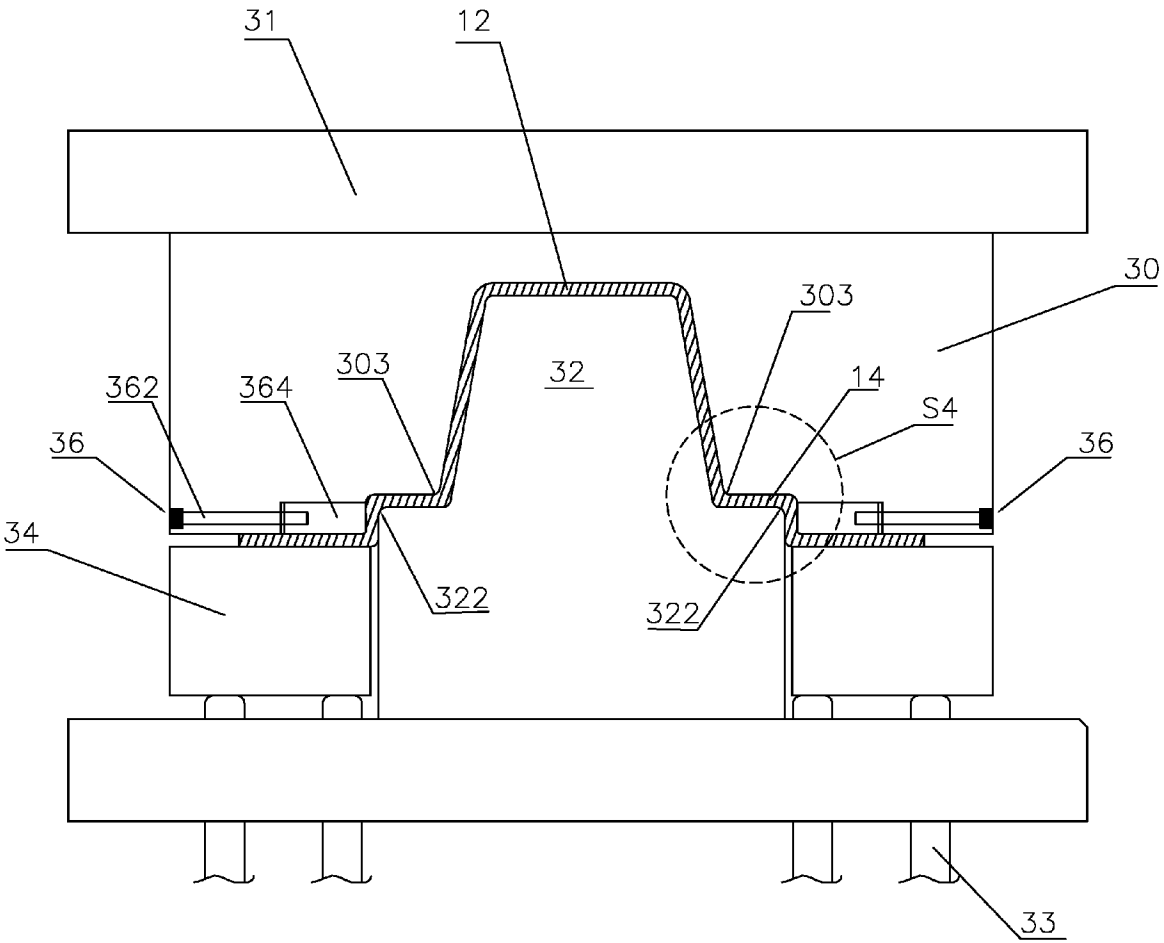
FIG. 8 illustrates the sixth status of the HSS formed by the power press machine of the present invention.

Please refer to FIG. 8 and note the circle S4. When the protrusion 321 of the convex die 32 entirely enters the concavity 301 of the convex die 32, a step portion 14 will be formed between the shoulder 322 and the recess 302. The step 14 can avoid recoil of the HSS 10. The step portions 14 with the side portions 12 are frills for guaranteeing entire elimination of internal stress of the HSS 10.

Figure 9:
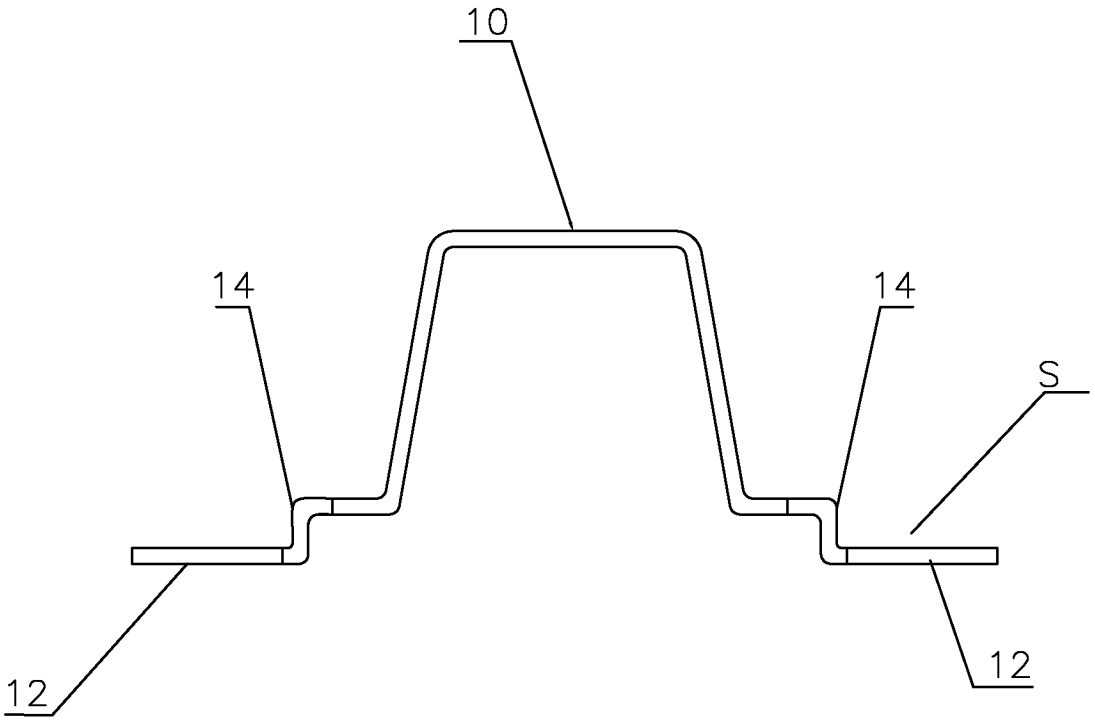
FIG. 9 illustrates the HSS which has been formed.
Figure 10:
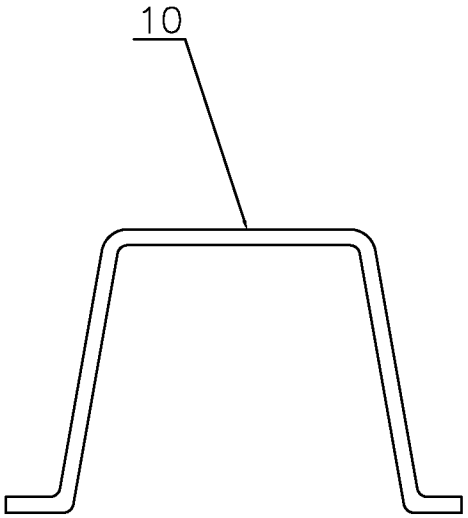
FIG. 10 illustrates the HSS which has been trimmed off.

FIG. 9 illustrates the HSS 10 which has been removed from the dies 30, 32. The step portions 14 are formed to completely eliminate internal stress. The last step is to cut off the step portions 14 with the side portions 12. FIG. 10 shows the HSS 10 after the step portions 14 and the side portions 12 has been cut off.

Please refer back to FIG. 8. An adjusting mechanism 36 is preferably disposed at an edge of concave die 30. The adjusting mechanism 36 is composed of an adjustable screw rod 362 and a block 364. The adjusting mechanism 36 can adjust the step portions 14 between the convex die 32 and depressor 34. The positions of the step portions 14 can be adjusted by rotating the screw rod 362 to make the block 364 move inward or outward to a specific position. This can change a relative depth of the step portions 14 formed by the convex die 32 and depressor 34. Thus, adjusting mechanism 36 can match requirements of different thickness, bending angles and/or properties of metal sheets so that the forming process can be preferably completed.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A power press machine comprising:

a concave die having a concavity and two recesses separately beside the concavity;

a convex die with a protrusion and two shoulders corresponding to the two recesses and two depressors separately beside the convex die; and an adjusting mechanism, disposed at an edge of concave die, having an adjustable screw rod and a block for adjusting two step portions between the convex die and two depressors.

* * * * *